US009145188B1

(12) United States Patent
Daneman

(10) Patent No.: US 9,145,188 B1
(45) Date of Patent: Sep. 29, 2015

(54) MOUNT PROVIDING EXTENSION TO A SHALLOW WATER ANCHORING SYSTEM

(71) Applicant: Stuart Emanuel Daneman, Sarasota, FL (US)

(72) Inventor: Stuart Emanuel Daneman, Sarasota, FL (US)

( * ) Notice: Subject to any disclaimer, the term of this patent is extended or adjusted under 35 U.S.C. 154(b) by 191 days.

(21) Appl. No.: 13/737,742

(22) Filed: Jan. 9, 2013

(51) Int. Cl.
*B63B 21/26* (2006.01)
*B63B 21/30* (2006.01)

(52) U.S. Cl.
CPC ..... *B63B 21/30* (2013.01)

(58) Field of Classification Search
CPC ..... B63B 21/26; B63B 21/22; B63B 21/30; B63B 21/29; B63B 21/24
USPC ..... 114/294, 295; 52/848, 220.8; 248/68.1, 248/74.4, 512, 523; 403/389, 391, 396, 403/385; 285/25, 26, 419; 269/91, 95, 900; 29/243.56
See application file for complete search history.

(56) References Cited

U.S. PATENT DOCUMENTS

| | | | | |
|---|---|---|---|---|
| 577,220 | A * | 2/1897 | Whitehead | 294/209 |
| 3,287,754 | A * | 11/1966 | Price et al. | 441/74 |
| 6,041,730 | A | 3/2000 | Oliverio | |
| 7,971,548 | B2 * | 7/2011 | Kuenzel | 114/294 |
| 8,104,418 | B1 | 1/2012 | Thompson | |
| 8,789,605 | B2 * | 7/2014 | Sessions et al. | 166/360 |

* cited by examiner

*Primary Examiner* — S. Joseph Morano
*Assistant Examiner* — Andrew Polay
(74) *Attorney, Agent, or Firm* — Dorothy S. Morse

(57) ABSTRACT

A mount extending the reach of a shallow water anchoring system, which includes a block mounting device with two open-ended and spaced-apart longitudinally-extending bores each having at least two smaller threaded bores with interior ends that are in communication with the longitudinal bores. Preferably, the smaller threaded bores are spaced apart and aligned in a row, and also have perpendicular orientation to the longitudinal bore. The extendable anchoring pole of a shallow water anchoring system is secured within one of the longitudinal bores via fasteners, while an independent rod longer than the anchoring pole is secured via fasteners within the other longitudinal bore, wherein the independent rod can be vertically deployed into a sea bottom adjacent to a boat at water depths exceeding the anchoring system's intended reach. A small stabilizer block with similar bores spaced apart from the mount further stabilizes the pole and independent rod during anchoring use.

18 Claims, 7 Drawing Sheets

MOUNT PROVIDING EXTENSION TO A SHALLOW WATER ANCHORING SYSTEM

CROSS REFERENCES TO RELATED APPLICATIONS

The applicant/inventor herein is the applicant/inventor of an earlier-filed and still pending U.S. design patent application for the large block mounting device disclosed and claimed herein for use to provide an extension to a shallow water anchoring system. The Filing Date of this U.S. design patent application is Sep. 22, 2011, it has the same title of "Mount Providing Extension to a Shallow Water Anchoring System", and it also was assigned the design patent application No. 29/402,387. Since the applicant's design patent application has not been abandoned and it is still waiting for processing by an Examiner, the applicant believes that co-pending status is present between it and the utility patent application now being filed. Thus, the applicant/inventor herein respectfully requests that domestic priority be granted for the utility patent application now being filed which has overlapping subject matter with the above-identified and earlier-filed U.S. design patent application also in his name.

BACKGROUND

1. Field of the Invention

The present invention is in the technical field of devices or accessories used with shallow water boat anchoring systems to extend their reach into deeper water than was originally intended for the anchoring system, more specifically to a generally rectangular block mounting device having two spaced-apart and open-ended longitudinally-extending bores which are substantially parallel to one another and preferably have a smooth interior, one of which is typically larger in diameter than the other, although not limited thereto. Both longitudinal bores extend completely through the length of the device. The block mounting device also preferably has at least two small threaded fastener bores in communication with each longitudinal bore that are offset longitudinally from the threaded fastener bores in communication with the adjacent longitudinal bore to provide sufficient room for easy hand-manipulation of the fasteners secured therein, with the small threaded bores associated with each longitudinal bore in the most preferred embodiments of the present invention also having perpendicular orientation to the longitudinal bore with which it is connected, and being further positioned in a row having substantially parallel orientation to the associated longitudinal bore. For user convenience and not a critical feature of the invention, both of the rows of small threaded fastener bores are most commonly located on the same side of the block mounting device. The small threaded fastener bores in both rows are also open-ended, with an interior end that is in communication with the longitudinal bore adjacent-most to it, thus allowing each of the interior ends of fasteners tightened in one of the rows to come in contact with a rod or pole (hereinafter "independent rod" without any intent of limitation) inserted through the longitudinal bore to place that independent rod in a secure fixed position relative to the block mounting device. The second row of open-ended small threaded fastener bores and the fasteners tightened therein, are used to secure the extendable anchoring pole of a shallow water anchoring system within the other longitudinal bore of the block mounting device to place the bock mounting device In a fixed position relative to the shallow water anchoring system. Typically when the diameter dimensions of the longitudinal bores are not the same size, the larger bore is used with the extendable anchoring pole of the shallow water anchoring system, but not limited thereto. The resulting adjacent positioning of the independent rod and the extendable anchoring pole allows the shallow water anchoring system to support the present invention block mounting device to which the independent rod is secured, without any permanent alteration or modification to the shallow water anchoring system or the boat to which the anchoring system is attached, and further allows repeated vertical deployment and retraction of the independent rod as needed. Thus, when a boat supporting a shallow water anchoring system has the block mounting device secured to its extendable anchoring pole and an independent rod is also supported by the same block mounting device in substantially parallel orientation to the extendable anchoring pole, and the boat then moves into water several feet beyond the intended reach of the shallow water anchoring system, the independent rod can be quickly and easily extended for insertion into the sea bottom by simply loosening and refastening the fasteners securing it to the block mounting device. No tools are required. Although not limited thereto, easily hand-manipulated thumb screws are preferably used with the present invention block mounting device to fix it to the extendable anchoring pole, as well as fix the independent rod to the block mounting device. Non-corroding threaded inserts (hereinafter referred to 'helicoils' without any intent of limitation) are also preferably positioned within each small fastener bore in the block mounting device to turn each into a threaded bore with reduced thread wear that provides the secure non-slip gripping needed to maintain fasteners in fixed positioning relative to the independent rod and the extendable anchoring pole of a shallow water anchoring system after repeated deployment and retraction of the independent rod. Furthermore, a smaller stabilizer block may be used with the present invention block mounting device for additional stabilization of the independent rod and the extendable anchoring pole during their transport and use, with the smaller stabilizer block also preferably having two spaced-apart, open-ended, and non-threaded bores therethrough that are similar in diameter to the longitudinal bores in the block mounting device, as well as one smaller open-ended and threaded fastener bore having an interior end in communication with one of the small stabilizer block's non-threaded bores.

2. Description of Related Art

People using boats in shallow water for fishing cannot use conventional anchors that are dragged across the sea bottom until they become securely engaged with bottom sediments or underwater rock formations, as their deployment makes noise that scares away fish. Also, the dragging typically creates environmental damage that disturbs fish habitat. In addition, anchors that are dragged do not always provide a quick, solid, and secure engagement with the sea bottom and may need to be repositioned multiple times until satisfactory engagement is achieved. Furthermore, each time repositioning of a dragged anchor occurs, more fish are scared away and more of the sea bottom becomes disturbed. To overcome these disadvantages and environmental disruption, many fishermen now use shallow water anchors that insert one or more rods or probes into the sea bottom, such as the inventions disclosed in U.S. Pat. No. 7,971,548 to Kuenzel (2011) and U.S. Pat. No. 6,041,730 to Oliverio (2000). Both can be quickly deployed, are less invasive of the sea bottom than a dragged anchor, and can be quickly deployed and removed. However, an important disadvantage of shallow water anchoring systems is that they inherently have a limited reach. Should a shallow water anchor typically reach a depth of approximately eight feet, and the boat connected to it moves temporarily and unexpectedly into water having a depth of ten feet or more, then the shallow water anchoring system becomes ineffective. The present invention block mounting device is designed to overcome this deficiency and secure an independent rod directly to the extendable anchoring pole of a shallow water anchoring system (typically one attached to a boat's transom, but not limited thereto), with the independent rod mounted in a position substantially parallel to that of the extendable anchoring pole, so that the independent rod can be silently inserted into the sea bottom close to the boat supporting it even when the sea bottom is several feet lower than the maximum reach of the extendable anchoring pole of the shallow water anchoring system secured to the boat. The independent rod used with the present invention will not drag across the sea bottom, or rip up sea grass during its deployment or retraction. In addition, the rod can be secured in, lowered/deployed within, and removed from, one of the longitudinal bores in the present invention block mounting device in seconds, and such temporary attachment to the block mounting device does not permanently alter or modify in any way the shallow water anchoring system, the independent rod, or the boat. Furthermore, attachment of the present invention block mounting device helps to add stability to the neck of the extendable anchoring pole in the shallow water anchoring system when the boat to which it is attached travels on a trailer. Additional stability is also provided when an optional small stabilizer block is used with the independent rod and the extendable anchoring pole at a spaced-apart distance below the present invention block mounting device. The small stabilizer block's structure includes two spaced-apart, open-ended, and non-threaded bores extending completely through it which are comparable in diameter to the longitudinal bores of the block mounting device, as well as one open-ended and smaller threaded fastener bore in communication with one of the larger non-threaded bores, thus allowing secure and fixed connection of the small stabilizer block to the extendable anchoring pole of a shallow water anchoring system with a single fastener, while an independent rod inserted through the other large non-threaded bore remains freely movable within that bore.

The invention thought to be closest to the present invention is disclosed in U.S. Pat. No. 8,104,418 to Thompson (2012) which discloses an adjustable boat anchoring system. However, many differences exist between the Thompson invention and the present invention. The Thompson invention has a pair of anchoring fixtures each having a base and a tube carried by the base, which extends across its associated base. One such anchoring fixture is mounted on the peripheral edge of the boat, with the second anchoring fixture mounted on the exterior of the boat's transom. Poles received in Thompson anchoring fixtures can be adjustably positioned to engage the sea bottom immediately adjacent to the boat. In contrast, the present invention teaches a block mounting device that attaches to the extendable pole of a shallow water anchoring system to secure an independent rod that can be deployed to allow the shallow water anchoring system to reach water depths at least several feet lower than originally intended, thereby providing secure anchoring in bays and other coastal or inter-coastal water where varying sea bottom depths are frequently encountered. Furthermore, the present invention block mounting device is secured to the extendable anchoring pole of a shallow water anchoring system, and not to the boat's hull, and does not permanently modify or alter any portion of the shallow water anchoring system or the boat. Also, it has two spaced-apart longitudinal bores that are oriented substantially parallel to one another within one block mounting device, and it does not use two tubes each with a separate base independently mounted to different portions of a boat. Thus, no invention is known with the same features as the present invention, or the same structure, or one that provides the same benefits and advantages to a user.

BRIEF SUMMARY OF THE INVENTION

The primary objective of this invention is to provide a means of providing an extension to a shallow water anchoring system that makes it usable in water at least several feet greater in depth than is possible with its original extendable anchoring pole. It is also an objective of this invention to provide an extension to a shallow water anchoring system that can be rapidly deployed and retracted in seconds. Another objective of this invention is to provide a block mounting device to which an extension of a shallow water anchoring system can be secured that has sturdy and durable construction, and a configuration which helps to stabilize both the extendable anchoring pole of a shallow water anchoring system and the independent rod employed with it as an anchoring extension. It is also an objective of this invention to provide a block mounting device that when placed into its contemplated position of use relative to boat for providing extension to a shallow water anchoring system does not cause any permanent or temporary modification/alteration to the shallow water anchoring system, the boat to which the shallow water anchoring system is attached, or the independent rod used as an anchoring extension. It is a further objective of this invention to provide a block mounting device that is made from materials unaffected by repeated exposure to water and saltwater. It is also an objective of this invention to provide a block mounting device that can be quickly and easily installed into and removed from its position of use. A further objective of this invention is to provide anchoring means that discretely extends the reach of a shallow water anchoring system without scaring away fish. It is a further objective of this invention to provide anchoring means that preserves the marine ecology, instead of destroying it, when employed to extend the reach of a shallow water anchoring system.

The present invention block mounting device is designed to secure an independent rod to the extendable anchoring pole of a shallow water anchoring system, so that the independent rod can be silently inserted into the sea bottom adjacent to the boat even when the water depth exceeds the reach of the anchoring system's original extendable anchoring pole by several feet. Thus, the reach of a six-foot or eight-foot shallow water anchoring system can be easily extended to ten or eleven feet, and even to approximately twenty feet in some applications. The independent rod will not drag across the marine bottom, or rip up sea grass. In addition, placement of the independent rod into its position of use within one of the longitudinal bores of the block mounting device does not cause any alteration or modification to the boat, and use of easily hand-manipulated thumb screws to secure the independent rod in place allows installation and removal of the independent rod in seconds. Installation and removal of the block mounting device from the extendable pole of a shallow water anchoring system is also fast, and does not cause any permanent or temporary modification to the boat. Also, when all fasteners are quick-release, thumb screws, no tools are needed. Furthermore, attachment of the present invention block mounting device helps to add stability to the extendable anchoring pole of the shallow water anchoring system when a boat is traveling on a trailer, and also during its use in the water. The most preferred embodiment of the present invention block mounting device comprises a piece of rigid material having a generally rectangular shape with chamfered edges and corners. It also has two open-ended, spaced-apart, and non-threaded bores of differing diameter dimension each longitudinally extending completely through the rigid material. In addition, the present invention block mounting device has at least two small, threaded, and open-ended fastener bores in communication with the larger one of the longitudinal bores, and at least two additional small threaded fastener bores in communication with the smaller longitudinal bore. Typically such small threaded fastener bores are spaced apart from others in the same row a sufficient distance to allow easy hand manipulation of all fasteners inserted therein, with longitudinal staggering of fastener bores associated with one longitudinal bore preferably staggered in position relative to those associated with the other longitudinal bore. Thus, when the extendable anchoring pole of a shallow water anchoring system is inserted into the larger longitudinal bore and fasteners are inserted into the small threaded bores in communication with the larger longitudinal bore and tightened, and further when an independent rod is inserted into the smaller one of the non-threaded longitudinal bores and fasteners are inserted into the small threaded bores in communication with the second longitudinal bore and tightened, the independent rod can become an extension for the original extendable anchoring pole of the shallow water anchoring system for prompt and silent entry into the sea bottom in water exceeding the maximum reach of the system. The independent rod is also quickly raised and lowered within the second longitudinal bore through easy hand-release of the tightened fasteners securing it to the block mounting device, followed by a subsequent retightening of the same fasteners once the desired deployable length of independent rod is achieved. No invention is known that has the same features as the present invention, the same structure, or provides the same benefits and advantages to a user.

COMPONENT LIST

Figure 1:
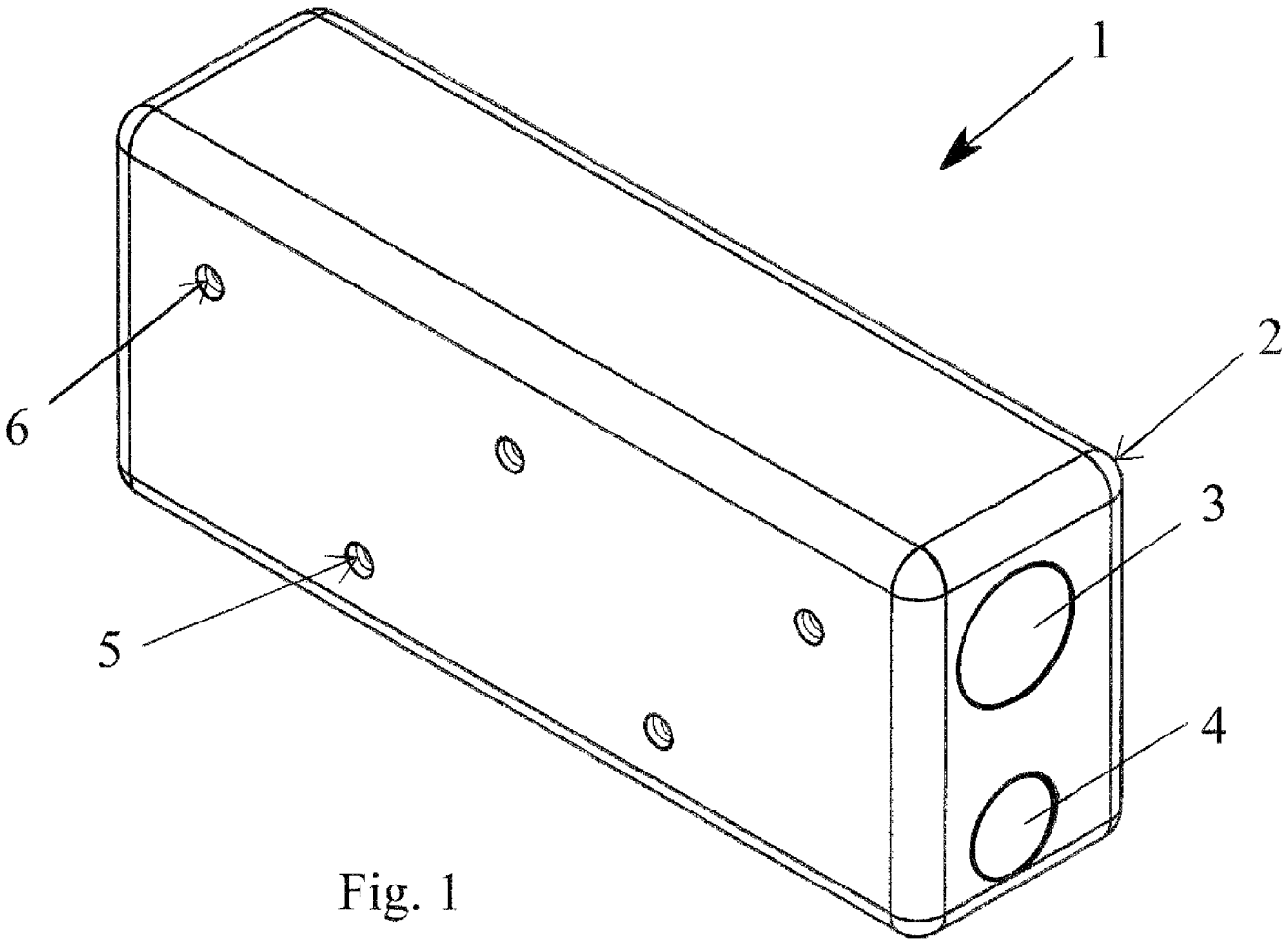
FIG. 1 is a perspective view of the block mounting device in the most preferred embodiment of the present invention, showing its chamfered edges and corners, two open-ended non-threaded longitudinal bores that extend through its the entire length, an exposed top surface without holes that during use of the block mounting device is positioned facing the boat supporting a shallow water anchoring system while the opposing bottom surface that is hidden from view is situated during use in a remote position from the boat, and two rows of smaller threaded bores positioned on one of its sides, with one of the rows in perpendicular orientation to and aligned with one of the longitudinal bores and the other row of smaller threaded bores in perpendicular orientation to and aligned with the second the longitudinal bore, and further with the smaller threaded bores in one row being offset or staggered longitudinally from the smaller threaded bores in the second row for easier and faster hand-manipulation of fasteners secured therein.

1. Block mounting device (having chamfered edges and corners 2)
1'. Block mounting device (having no chamfered edges or corners)
2. Chamfered edges and corners
3. Large/larger non-threaded bore in block mounting devices 1, 1' and stabilizer blocks 13, 13'
4. Small/smaller non-threaded bore in block mounting devices 1, 1' and stabilizer blocks 13, 13'
5. Small threaded bore on one side of block mounting devices 1, 1' that communicates with smaller bore 4
6. Small threaded bore on one side of block mounting devices 1, 1' and stabilizer blocks 13, 13' that communicates with large bore 3
7. Shallow water anchoring system
8. Boat (supports shallow water anchoring system 7)
9. Transom of boat 8
10. Extendable anchoring pole of shallow water anchoring system 7
11. Threaded fastener (usable with threaded bores 5, 6, and 14 to fix extendable anchoring pole 10 and independent rod 12 in their usable positions)
12. Independent rod (used as an extension for the extendable anchoring pole of shallow water anchoring system 7, see suggested materials in paragraph 018 below)
13. Stabilizer block (having chamfered edges and corners 2)
13'. Stabilizer block (having no chamfered edges or corners)
14. Threaded fastener bore (on one side of stabilizer blocks 13, 13' and communicates with its large bore 3)
15. Helicoil (used in threaded bores 5, 6, and 14 to reduce wear thereof and prevent slippage of fasteners 11 after repeated tightening/release of fasteners 11 within bores 5, 6, and 14)

DETAILED DESCRIPTION OF THE INVENTION

The present invention is a block mounting device 1 and its first and preferred embodiment has two spaced-apart non-threaded longitudinal bores (3 and 4) and a plurality of smaller threaded fastener bores (5 and 6) each having an interior end in communication with longitudinal bore 3 or 4. Preferably, but not limited thereto, smaller threaded bores 5 and 6 are in perpendicular orientation to non-threaded longitudinal bores 3 and 4, or otherwise configured to provide secure engagement of the interior end of a fastener 11 with the side surface of the extendable anchoring pole 10 of a shallow water anchoring system 7 or an independent rod 12 so that pole 10 or rod 12 achieves fixed positioning relative to mounting block device 1. As can be seen in FIG. 1, the smaller threaded bores 5 and 6 in the most preferred embodiment of the present invention are also preferably aligned in two longitudinally-extending rows that have parallel orientation to the non-threaded longitudinal bores 3 and 4. Also, although in the most preferred embodiment of the present invention block mounting device 1 the interior surfaces of longitudinal bores 3 and 4 are non-threaded and smooth, such configuration is not critical. Furthermore, depending upon the diameter dimension of the independent rod 12 providing extension for a shallow water anchoring system 7, longitudinal bores 3 and 4 may have the same diameter dimension, bore 3 may have a larger diameter dimension than bore 4 (as shown in FIG. 1), or bore 4 may be larger in diameter than bore 3. In addition, although longitudinal bores 3 and 4 are shown in the accompanying illustrations each having a circular perimeter configuration, other perimeter configurations may be used for longitudinal bores 3 and 4 in shallow anchoring applications with different types of rods and poles and should be considered as being within the scope of the present invention. Furthermore, while the independent rod 12 used in bore 4 is typically made from high-strength pultruded fiberglass composite (such as that available from Tencom Ltd. located near Toledo, Ohio) or epoxy resin, and may be employed for multiple purposes on boat 8, when it has a diameter dimension less than that of the extendable anchoring pole 10 of the shallow water anchoring system 7 attached to boat 8, the diameter dimension of bore 4 in block mounting device 1 during its manufacture is made smaller than the diameter dimension of bore 3. However, additional poles or rods of differing diameter may also be used to fulfill the anchoring extension function of independent rod 12 (which might then dictate different diameter dimensions and shapes for longitudinal bores 3 and 4 than are shown in the accompanying illustrations), including but not limited to those made from solid reinforced polyester resin (similar to the material used in 8-ft anchoring pins for kayaks), lightweight and high-strength basalt rebar or other corrosion-resistant rebar made for marine environments, and steel mounting poles having a corrosion-resistant finish adapted for marine use.

Thus, in the first and most preferred embodiment of the present invention, the extendable anchoring pole 10 of a shallow water anchoring system 7 is usually inserted into a larger longitudinal bore 3 of block mounting device 1, and then fixed in position and orientation to block mounting device 1 using a different easily-hand-manipulated fastener 11 tightened into each of the smaller bores 6 in communication on its interior end with bore 3. Then, an independent rod 12 (having a longer length dimension that extendable anchoring pole 10) may be inserted into the smaller longitudinal bore 4 and similarly fixed in position and orientation relative to block mounting device 1 using additional easily-hand-manipulated fasteners 11 tightened into the smaller bores 5 that are in communication on their interior end with smaller longitudinal bore 4. When not deployed for anchoring use, the lower end of independent rod 12 is positioned close in the location to the bottom end of extendable anchoring pole 10 of the shallow water anchoring system (either the same height, slightly higher, or slightly lower). However, when employed as an extension for shallow water anchoring system 7, the lower end of independent rod 12 can be easily and rapidly moved downwardly to exceed the positioning of the bottom end of extendable anchoring pole 10 by at least two to three feet, and even more (perhaps as much as twenty fee in some applications), so that it becomes inserted into the sea bottom adjacent to a boat 8 a sufficient amount for anchoring purposes. Thus, independent rod 12 becomes secured in block mounting device 1 to act as an extension for extendable anchoring pole 10 and function in place of the extendable shallow water anchoring pole 10 of a shallow water anchoring system 7 in depths of water that exceed the intended reach of shallow water anchoring system 7, thereby turning shallow water anchoring system 7 into a deeper water anchoring system possibly reaching a depth of approximately twenty feet, instead of only six to ten feet, and this present invention use allows such extension to occur without modification or alteration of the boat 8 to which the shallow water anchoring system 7 is attached. Although any fastener with a properly-sized diameter can be used in the smaller threaded bores 5, 6, and 14 (see FIG. 8), easily-hand-manipulated fasteners are preferred, such as but not limited to the thumb screw 11 shown in FIG. 7.

Figure 3:
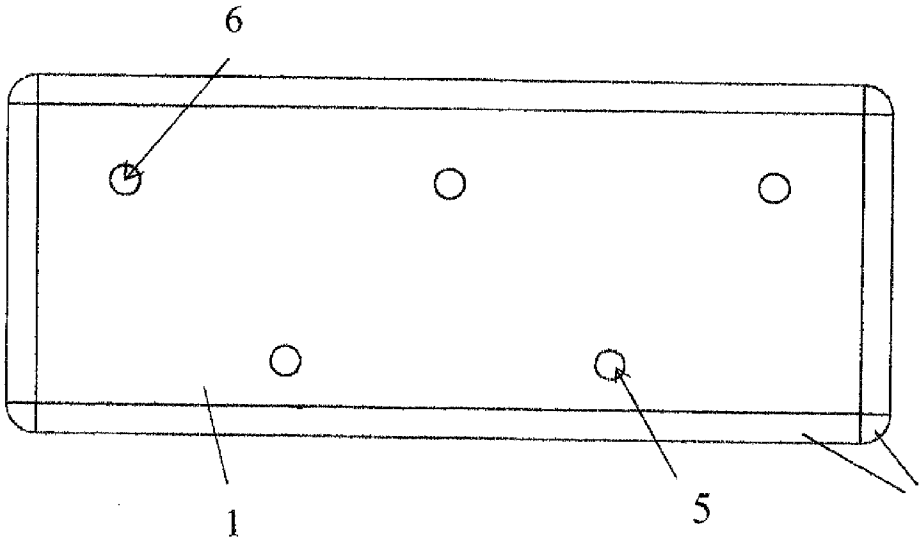
FIG. 3 is a front view of the block mounting device in the most preferred embodiment of the present invention shown in FIGS. 1 and 2 having chamfered edges and corners, and the external/open ends of several spaced-apart and laterally-extending smaller threaded bores extending through one of its sides.
Figure 4:
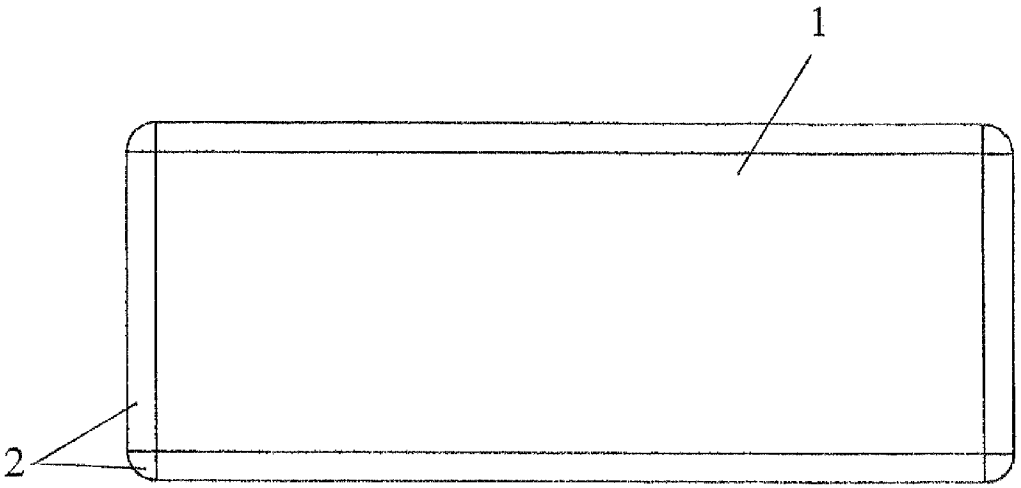
FIG. 4 is a rear view of the block mounting device in the most preferred embodiment of the present invention shown in FIGS. 1-3 having no design features or surface ornamentation other than its chamfered edges and corners.
Figure 5:
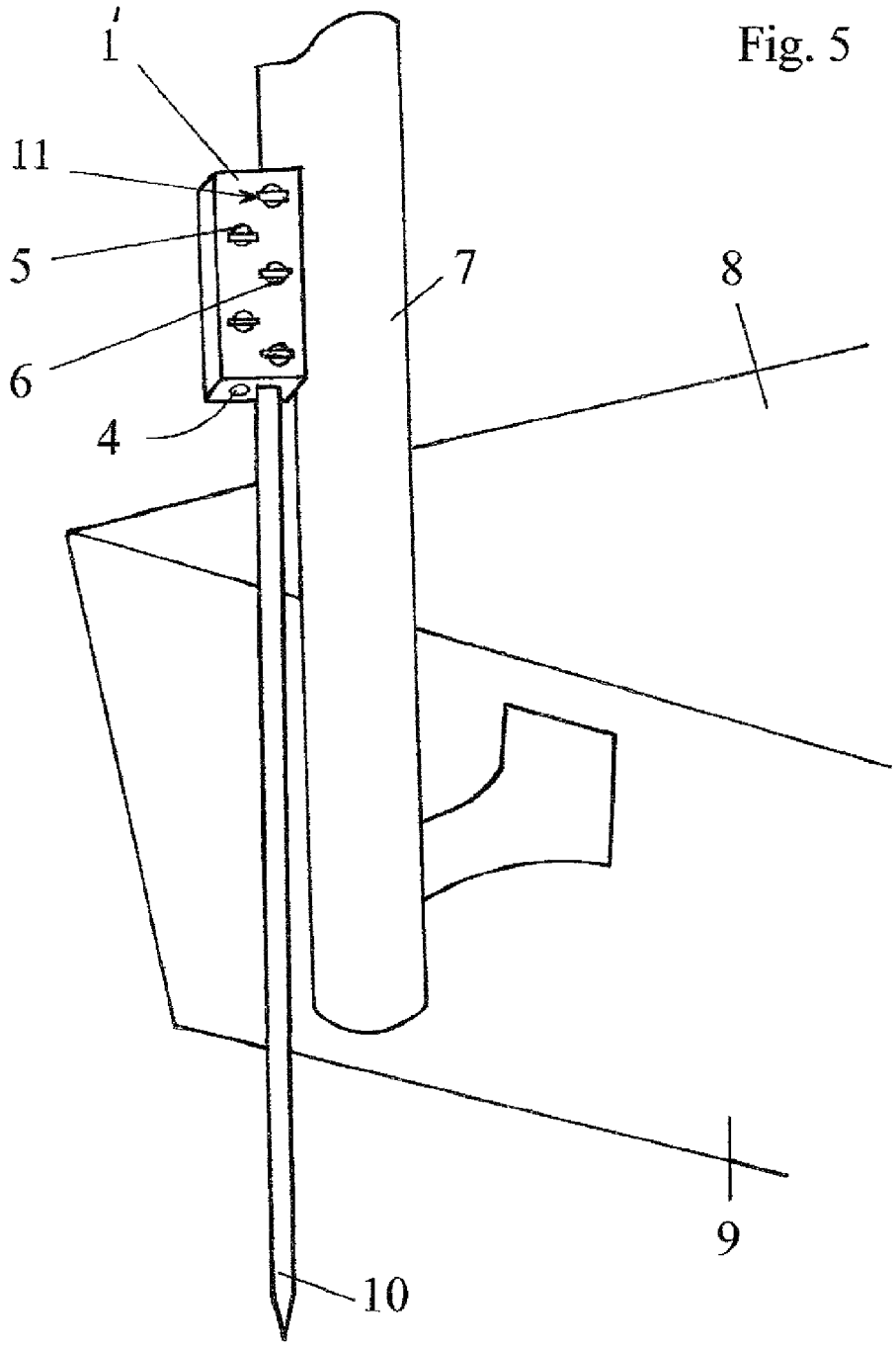
FIG. 5 is a perspective view from the side of the block mounting device in a second preferred embodiment of the present invention secured via fasteners to the extendable anchoring pole of a shallow water anchoring system that has been attached to the transom of a boat, with the extendable anchoring pole and the shallow water anchoring system in their non-deployed positions, the second preferred embodiment differing from the first preferred embodiment by having no chamfered edges or corners.
Figure 6:
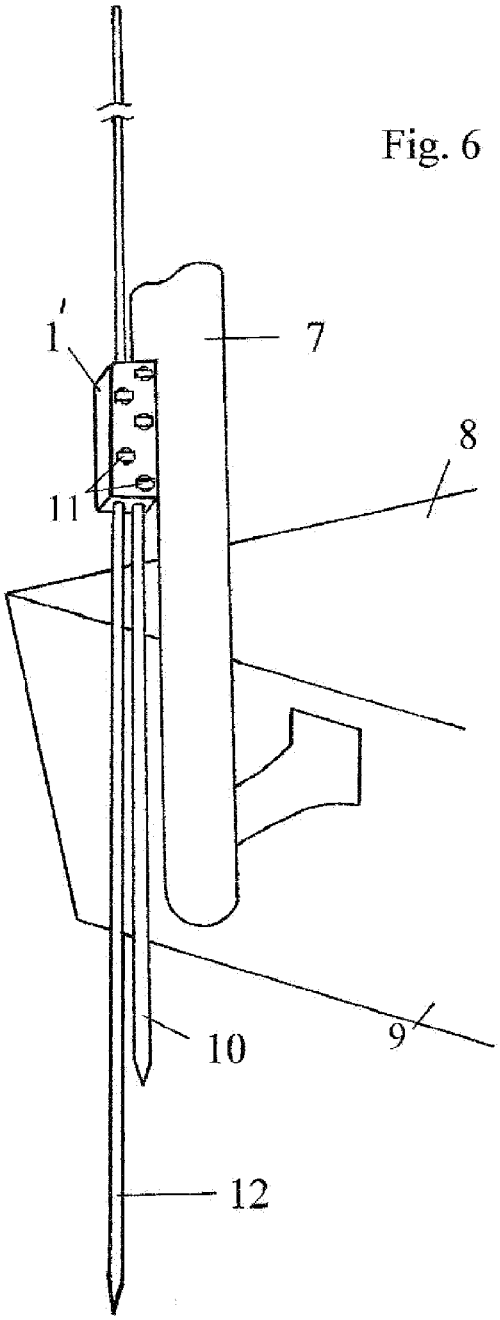
FIG. 6 is a perspective view of the block mounting device in the second preferred embodiment of the present invention having the extendable anchoring pole of a shallow water anchoring system secured within its large longitudinal bore by fasteners, the supportive portion of the shallow water anchoring system secured to the transom of a boat, the extendable anchoring pole and the shallow water anchoring system in their non-deployed positions, and an independent rod extending secured within the smaller longitudinal bore of the block mounting device via fasteners so that it can be used to extend the reach of the extendable anchoring pole without permanent modification to the boat or the shallow water anchoring system.
Figure 7:
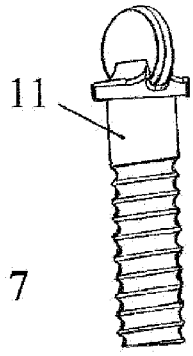
FIG. 7 is a side view of a fastener usable with preferred embodiments of the present invention to secure an independent rod or the extendable anchoring pole of a shallow water anchoring system to the block mounting device.
Figure 8:
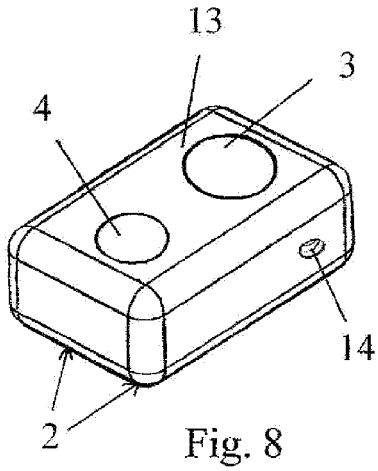
FIG. 8 is a perspective view of a first preferred embodiment of an optional smaller stabilizer block usable with the block mounting device to provide additional stabilization to an independent rod and the extendable anchoring pole of a shallow water anchoring system when secured to the extendable anchoring pole at a spaced-apart distance from the block mounting device, with FIG. 8 also showing the stabilizer block's preferred chamfered edges and corners, two open-ended non-threaded bores that extend entirely through it, and one smaller threaded bore positioned in perpendicular orientation to and aligned with the larger non-threaded bore, which is used with a fastener to secure the smaller stabilizer block to the extendable anchoring pole of a shallow water anchoring system.
Figure 9:
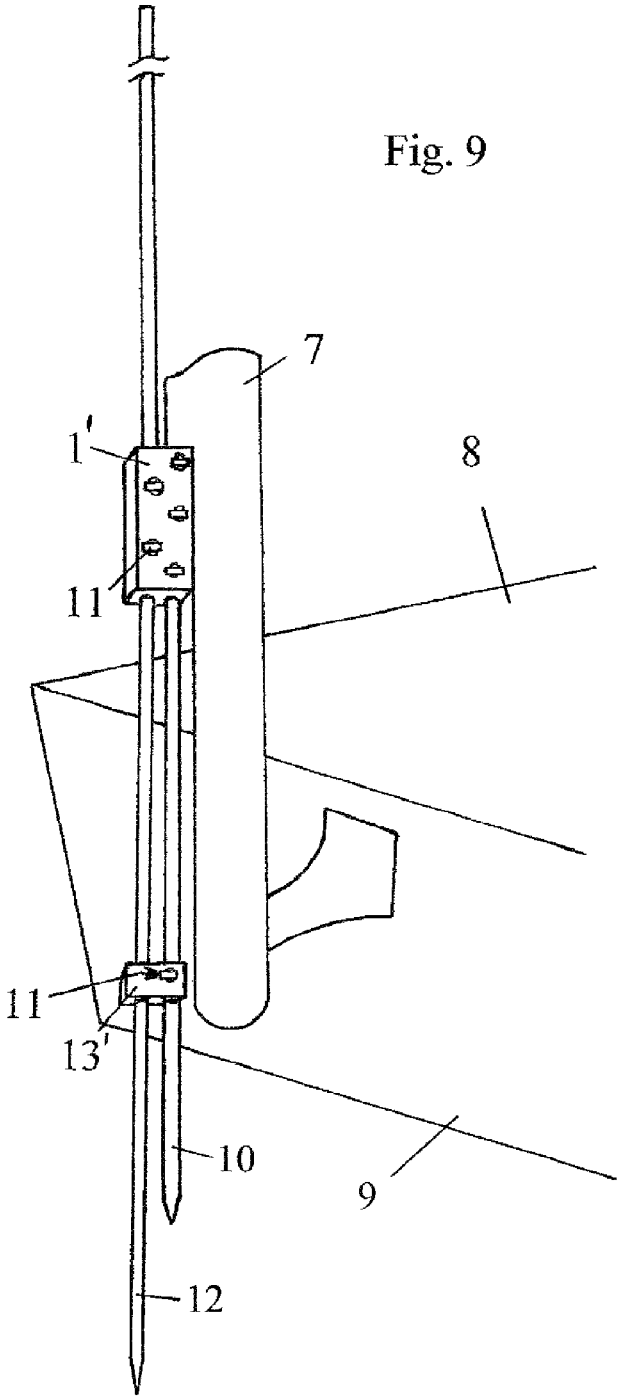
FIG. 9 is a perspective view from the side of the block mounting device in the second preferred embodiment of the present invention having the extendable anchoring pole of a shallow water anchoring system secured within its large longitudinal bore via fasteners, an independent rod secured within its small longitudinal bore via fasteners, the independent rod also extending through the smaller bore of a second preferred embodiment of smaller stabilizer block without chamfered edges and corners and not secured to the smaller stabilizer block with any fastener so that it remains able to move freely therein, the smaller stabilizer block secured to the anchoring pole of a shallow water anchoring system with one fastener, and the shallow water anchoring system secured to the transom of a boat and shown in a non-deployed configuration.
Figure 10:
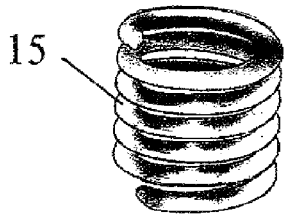
FIG. 10 is a perspective view from the side of a helicoil that can be used as a part of the fastener holes in preferred embodiments of the present invention block mounting device and smaller stabilizer block to reduce wear thereof and prevent slippage of fasteners used to secure the block mounting device to an independent rod and the block mounting device and smaller stabilizer block to the extendable anchoring pole of a shallow water anchoring system.
Figure 11:
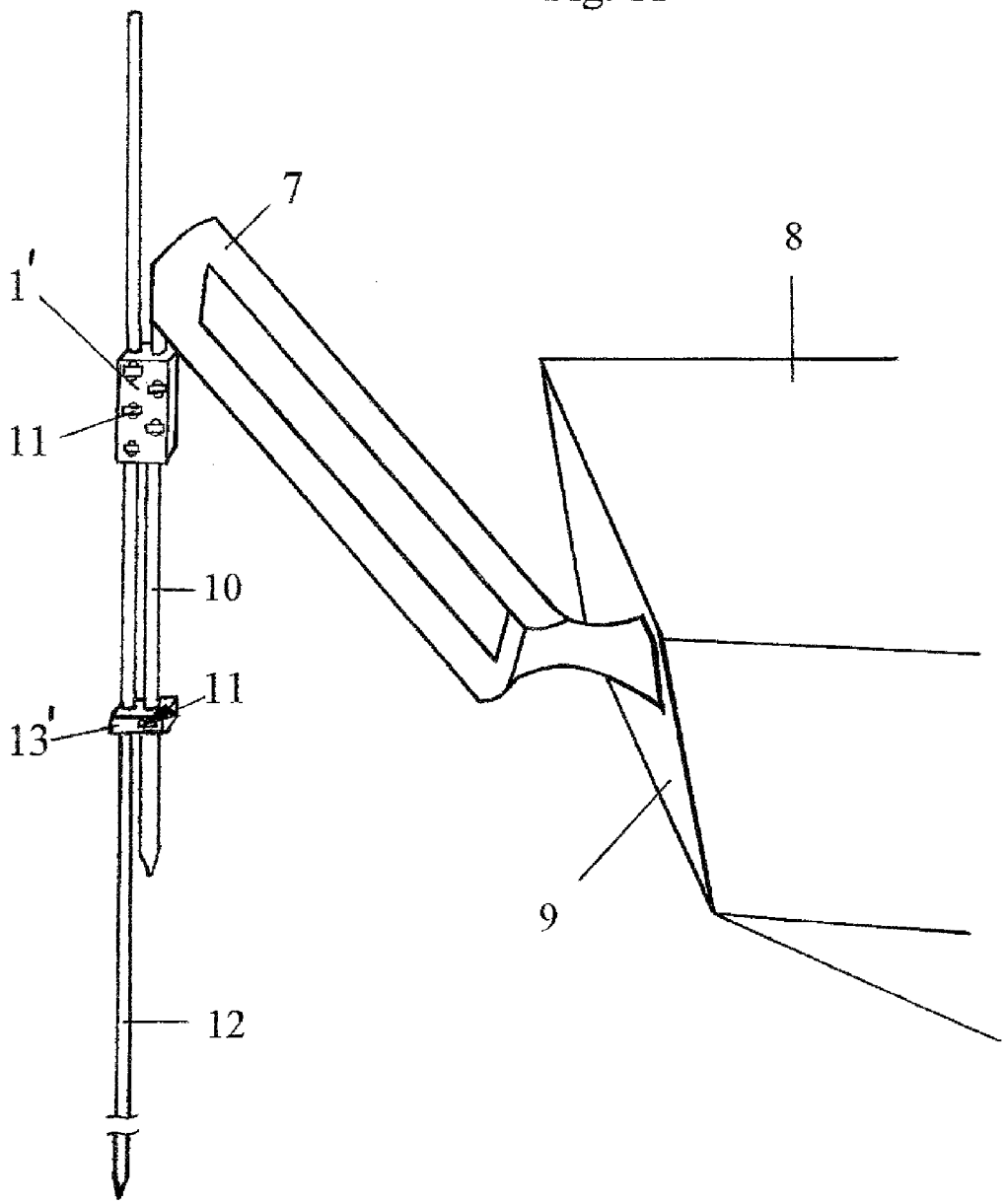
FIG. 11 is a perspective view from the side of the block mounting device in the second preferred embodiment of the present invention having the extendable anchoring pole of a shallow water anchoring system secured within its large longitudinal bore via fasteners, an independent rod secured within its small longitudinal bore via fasteners, the independent rod also extending through the smaller bore of a stabilizer block and remaining freely movable therein, the stabilizer block secured to the anchoring pole of a shallow water anchoring system with one fastener, and the shallow water anchoring system secured to the transom of a boat and in a partially-deployed configuration.

FIGS. 1-4 show the features of the first and most preferred embodiment of the present invention's block mounting device 1, while FIG. 7 shows an example of a fastener 11 that can be used with the present invention. In addition, FIG. 5 shows a second preferred embodiment of the present invention block mounting device 1' without chamfered edges and corners connected to the extendable anchoring pole 10 of a prior art shallow water anchoring system 7 with multiple fasteners 11, and FIG. 6 shows the second preferred embodiment of the present invention block mounting device 1' securely connected via several fasteners 11 to the extendable anchoring pole 10 of a prior art shallow water anchoring system 7 and also to an independent rod 12 using additional fasteners 11. FIG. 8 shows a first preferred embodiment of smaller stabilizer mount 13 that can be used with the present invention's block mounting devices 1, 1' to further stabilize independent rod 12, while FIG. 10 shows a helicoil 15 that is usable with preferred embodiments of the present invention to tightly fix fasteners 11 within threaded bores 5, 6, and 14, as well as reduce wear and maintain a secure fit of fasteners 11 within threaded bores 5, 6, and 14 during repeat use. FIGS. 9 and 11 show a second preferred embodiment of stabilizer mount 13' without chamfered edges and corners used in association with the extendable anchoring pole 10 of a prior art shallow water anchoring system 7 and an independent rod 12, with FIG. 9 showing shallow water anchoring system 7 in a non-deployed position and FIG. 11 showing shallow water anchoring system 7 in a partially-deployed position. Also, in the fully deployed position of shallow water anchoring system 7, although not shown, extendable anchoring pole 10 and independent rod 12 would have the same substantially vertically-extending orientation shown in FIGS. 9 and 11, while the portion of shallow water anchoring system 7 between boat 8 and extendable anchoring pole 10 would have a substantially horizontally-extending orientation.

FIGS. 1-4 show the first and most preferred embodiment of the present invention block mounting device 1 from several different views. FIG. 1 is a perspective view of the mounting block in the first and most preferred embodiment of the present invention that shows block mounting device 1 having two spaced-apart longitudinally-extending bores 3 and 4. Although not limited thereto, block mounting device 1 has a width dimension of approximately three-and-one-sixteenth inches and longitudinal bores 3 and 4 that are approximately five-eighths inches apart. Although FIG. 1 shows bore 3 having a larger diameter dimension than bore 4, and the positioning of bores 3 and 4 are precisely determined for best use with one type of shallow water anchoring system 7, it is considered to be within scope of the present invention for bores 3 and 4 to have different diameter dimensions and different spaced-apart positioning if needed for attachment to shallow water anchoring systems 7 made by different manufacturers. FIG. 1 also shows three smaller threaded bores 6 in perpendicular orientation to longitudinal bore 3. Although not visible in FIG. 1, the interior ends of smaller threaded bores 6 are in communication with longitudinal bore 3 so that as a fastener 11 is threaded into each small bore 6 and tightened, the interior end of the fastener 11 can engage the side surface of the extendable anchoring pole 10 of a shallow water anchoring system 7 inserted into longitudinal more 3 and securely fix the present invention block mounting device 1 in position relative to extendable anchoring pole 10. Similarly, FIG. 1 shows two smaller threaded bores 5 in perpendicular orientation to longitudinal bore 4. Although the perpendicular orientation of threaded fastener bores 5 and 6 relative to longitudinal bores 3 and 4 is shown and preferred, any orientation of threaded bores 5 and 6 is considered to be within the scope of the present invention that allows fasteners 11 to securely maintain extendable anchoring pole 10 and independent rod 12 within longitudinal bores 3 and 4 of block mounting device 1. Although not visible in FIG. 1, the interior ends of smaller threaded bores 5 are in communication with longitudinal bore 4 so that as a different fastener 11 is threaded into each small bore 5 and tightened, the interior end of the fastener 11 can engage the side surface of the independent rod 12 to securely fix independent rod 12 in position relative to the present invention block mounting device 1. The number, placement, orientation, and size of the small threaded bores 5 and 6 depicted in FIG. 1 are merely representative, although preferred, and they may differ from that shown and still be considered within the scope and spirit of the present invention. In addition, although even spacing between all small threaded bores 5 and 6 in present invention block mounting device 1 is shown in FIG. 1, and such spacing is preferred, it is not required. Furthermore, although FIG. 1 shows present invention block mounting device 1 having chamfered edges and corners 2, and such chamfered edges and corners 2 are preferred, they are not critical to the present invention as can be seen in the second preferred embodiment 1' shown in FIGS. 5, 6, 9, and 11.

Figure 2:
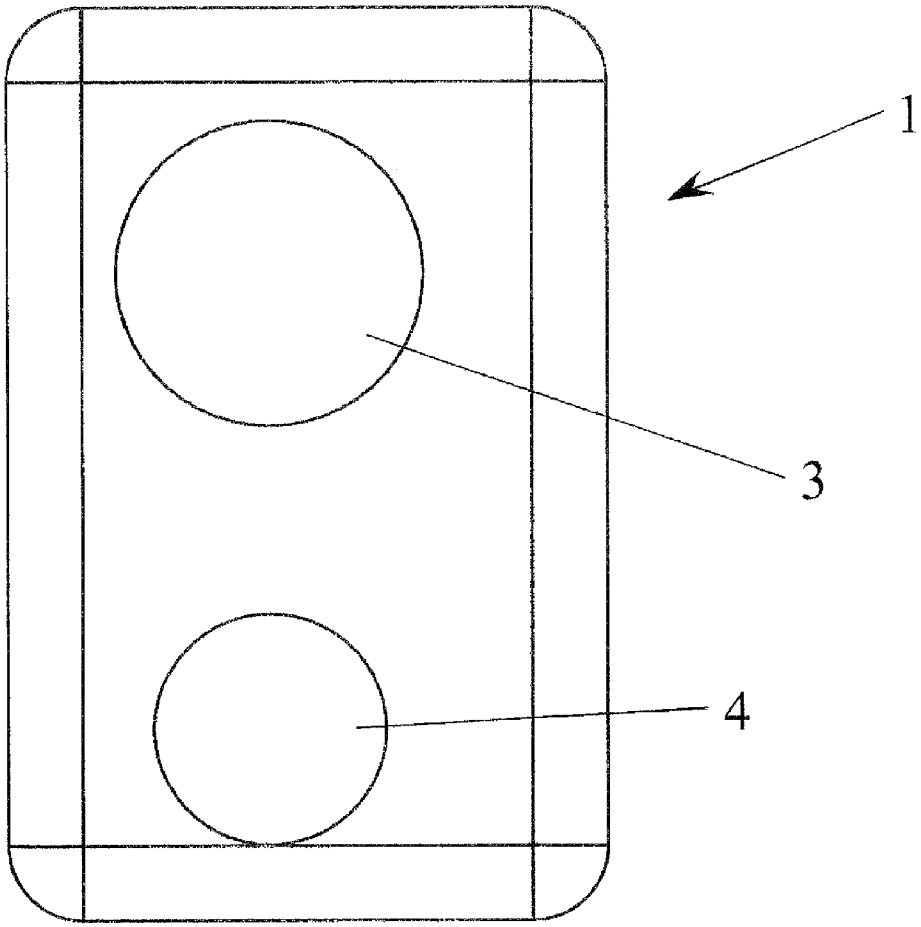
FIG. 2 is an end view of the block mounting device in the most preferred embodiment of the present invention showing one of its ends having two non-threaded bores therethrough comprising a large non-threaded longitudinal bore in spaced-apart relation with a smaller non-threaded longitudinal bore, with the center of each non-threaded longitudinal bore being in a non-centered position laterally between the sides of the block mounting device and also aligned with one another so that each is approximately the same distance from the closest side thereof, which would be the same side shown in FIG. 1 having the rows of smaller threaded bores, with FIG. 2 also showing the two non-threaded longitudinal bores positioned so that the large non-threaded longitudinal bore is closer to the longitudinal axis of the block mounting device and the smaller non-threaded longitudinal bore is closer to the adjacent bottom surface of the block mounting device than the large non-threaded longitudinal bore is to the top surface thereof.

FIG. 2 is an end view of the mounting block device 1 in the most preferred embodiment of the present invention showing a large longitudinal bore 3 spaced apart from a smaller longitudinal bore 4. The distance shown between large longitudinal bore 3 and smaller longitudinal bore 4, as well as alignment of the centers of longitudinal bores 3 and 4, provides balanced positioning of mounting block device 1 when it is attached to both independent rod 12 and the extendable anchoring pole 10 of a shallow water anchoring system 7. In the alternative, the diameter dimensions and spacing of longitudinal bores 3 and 4 shown in FIGS. 1 and 2 are merely representative, and it is considered to be within the scope of the present invention for longitudinal bores 3 and 4 to be different from that shown in FIGS. 1 and 2, when needed for attachment to other types of shallow water anchoring systems (not shown). FIG. 3 is a front view of the mounting block device 1 in the most preferred embodiment of the present invention showing laterally-extending smaller threaded fastener bores 5 and 6 aligned in two longitudinally-extending rows that are substantially parallel to one another. As previously mentioned in the above discussion of FIG. 1, the interior ends of smaller threaded bores 6 communicate with large longitudinal bore 3, while the interior ends of smaller threaded bores 5 communicate with small longitudinal bore 4. Although in the most preferred embodiment smaller threaded bores 5 and 6 are shown on the same side of mounting block device 1, such positioning is not critical. FIG. 4 is a rear view of the mounting block device 1 in the first and most preferred embodiment of the present invention showing no fastener bores 5 or 6 or other ornamentation or surface decoration, only chamfered edges and corners 2.

In viewing FIG. 5 wherein the second preferred embodiment of block mounting device 1' is secured to the extendable anchoring pole 10 of a shallow water anchoring system 7, one can envision additional variations in the positioning of smaller threaded bores 5 and 6 that are not shown in FIGS. 1-4, but which are also considered to be within the scope of the present invention. The longitudinal bore 3 that is used to secure block mounting device 1' to extendable anchoring pole 10 can only receive fasteners 11 through smaller threaded bores 6 extending through the front or back of block mounting device 1'. Due to the close positioning of block mounting device 1' against the supportive portion of shallow water anchoring system 7 that assists in the deployable movement of extendable anchoring pole 10, smaller threaded bores 6 through the side of block mounting device 1' adjacent to the supportive portion of shallow water anchoring system 7 would not be accessible for easy and rapid attachment and release of fasteners 11 when shallow water anchoring system has non-deployed positioning and the block mounting device 1' secured to extendable anchoring pole 10 is within close reach of a person (not shown) on boat 8. In contrast, as further seen in FIG. 5, the longitudinal bore 4 that is used to secure an independent rod 12 to block mounting device 1' in the most preferred embodiments of the present invention can be positioned to receive fasteners 11 through smaller threaded bores 5 extending through the front, back, and adjacent side of block mounting device 1' since there is nothing positioned close to that side of block mounting device 1' during its use that would prevent the tightening and release of fasteners 11 in smaller threaded bores 5 positioned on the side of block mounting device 1' remotely positioned from boat 8. However, the positioning of smaller threaded bores 5 and 6 shown in FIG. 5 provide the most convenient use, and are preferred. As shown in FIG. 5, although no independent rod 12 is positioned within longitudinal bore 4, fasteners 11 may still remain secured within smaller threaded bores 5 for fast fixed positioning of independent rod 12 within longitudinal bore 4 when needed.

FIG. 5 shows the second preferred embodiment of present invention block mounting device 1' connected to the extendable anchoring pole 10 of a prior art shallow water anchoring system 7 with three fasteners 11, while FIG. 6 shows the second preferred embodiment of present invention block mounting device 1' securely connected to the extendable anchoring pole 10 of a prior art shallow water anchoring system 7 with three fasteners 11 and additionally being securely connected to an independent rod 12 with two additional fasteners 11. The number of fasteners 11 used is not critical, and can be different from that shown. Preferably, threaded fastener bores 5 and 6 should all remain sufficiently spaced-apart from one another for fast and easy hand-manipulation of the fasteners 11 used therein. FIGS. 5 and 6 each show a shallow water anchoring system 7 attached to the transom 9 of a boat 8, and the use of block mounting device 1' to extend the reach of shallow water anchoring system 7 to additional depths without permanent alteration or modification of boat 8 or shallow water anchoring system 7. One should note that the features of boat 8 and shallow water anchoring system 7 are not drawn to-scale, and instead are merely representative as they have been adjusted in part to fit the size limitations of an 8.5 inch by 11 inch sheet of paper. FIGS. 5 and 6 further show shallow water anchoring system 7 in a stowed (non-deployed) position for travel. Furthermore, due to the size limitation of the drawing sheet, the top end of independent rod 12 is drawn with broken lines in FIG. 6 to indicate that in actual use independent rod 12 would be longer in an upwardly direction than is shown. While the diameter dimension of independent rod 12 is not critical, it should be substantial enough for anchoring use, and in the most preferred embodiment of the present invention independent rod 12 substantially fills longitudinal bore 4 (although independent rod 12 should not have too tight a fit within bore 4 that would otherwise prevent rapid and easy movement thereof within longitudinal bore 4). FIGS. 6, 9, and 11 show independent rod 12 having a tapered lower end, which is preferred but not critical for insertion into the sandy sea bottom commonly found in shallow waters. It is also preferred for the fasteners 11 shown in FIGS. 5 and 6 to be configured for fast and easy tightening and release via hand-manipulation, so that no tools are required for the downward anchoring deployment of independent rod 12, when needed to extend the reach of extendable anchoring pole 10. Also, although the configuration of a preferred fastener 11 is shown in FIG. 7, it is merely representative and fasteners having other head configurations and thread count could also be used with block mounting device 1 as long as the intended function of such fasteners is fulfilled (to secure block mounting device 1 to the extendable anchoring pole 10 of a shallow water anchoring system 7 and prevent its slippage within longitudinal bore 3 while an independent rod 12 secured by additional fasteners 11 to block mounting device 1' in the adjacent longitudinal bore 4 is employed as an extension of extendable anchoring pole 10).

While FIG. 8 shows a first and most preferred embodiment of a small stabilizer block 13 with chamfered edges and corners 2 that can be used with the present invention block mounting devices 1, 1' to further stabilize independent rod 12 during its use, FIGS. 9-10 show a second preferred embodiment of stabilizer block 13' without chamfered edges or corners 2 employed with the extendable anchoring pole 10 of a prior art shallow water anchoring system 7 and an independent rod 12. Although use of stabilizer blocks 13, 13' is optional and may not always be needed, its use is generally preferred. FIG. 8 shows the preferred vertical height of small stabilizer block 13 having a smaller dimension that its length or width dimensions. FIG. 8 also shows small stabilizer block 13 having one larger non-threaded vertically-extending bore 3 therethrough and a threaded fastener bore 14 in perpendicular orientation thereto. Similar to the construction of block mounting devices 1, 1', the interior end of threaded fastener bore 14 communicates with larger bore 3. In addition, FIG. 8 shows a second smaller non-threaded and vertically-extending bore 4 through small stabilizer block 13, but no threaded fastener bore 14 communicating therewith, as it is intended for the lower end of an independent rod 12 inserted through the smaller non-threaded vertically-extending bore 4 of small stabilizer block 13 to move freely therein.

FIG. 9 is a perspective view of the second preferred embodiment of mounting block device 1' in the most preferred embodiment of the present invention having the extendable anchoring pole 10 of a shallow water anchoring system 7 secured within its large longitudinal bore 3 and an independent rod 12 extending through its small longitudinal bore 4. FIG. 9 further shows the independent rod 12 also extending through the smaller vertically-extending bore 4 of the second preferred embodiment of small stabilizer block 13' and being freely movable therein (with no associated fastener 11 holding it in place) and small stabilizer block 13' secured to extendable anchoring pole 10 with one fastener 11 within the adjacent vertically-extending bore 3. In addition, FIG. 9 shows shallow water anchoring system 7 in a non-deployed configuration adjacent to the transom 9 of a boat 8. In this non-deployed configuration, it would be expected for the top end of independent rod 12 to extend at least 2-4 feet (and perhaps more) above the top end of shallow water anchoring system 7, with the drawing sheet size limitation preventing this from being illustrated to-scale. In contrast, FIG. 11 is a similar perspective view to that shown in FIG. 9, with mounting block device 1' in the second preferred embodiment of the present invention having the extendable anchoring pole 10 of a shallow water anchoring system 7 secured within its larger longitudinal bore 3 via several fasteners 11 and an independent rod 12 extending through its smaller longitudinal bore 4 and also secured to block mounting device 1' with several fasteners 11. FIG. 11 also shows the independent rod 12 extending through the smaller vertically-extending bore 4 of the second preferred embodiment of small stabilizer block 13' and being freely movable therein (with no associated fastener 11 is holding it in a fixed position) and small stabilizer block 13' secured to extendable anchoring pole 10 with one fastener 11 via its vertically-extending bore 3. In contrast to FIG. 9, FIG. 11 shows shallow water anchoring system 7 in a partially-deployed configuration and positioned away from the transom 9 of boat 8. Although not shown, in a fully-deployed configuration, the portion of shallow water anchoring system 7 positioned between extendable anchoring pole 10 and the transom 9 of boat 8 would have a substantially horizontally-extending orientation, and extendable anchoring pole 10 and independent rod 12 would each have the same substantially vertically-extending orientation shown in FIGS. 9 and 11. However, it would be expected for the bottom end of independent rod 12 to extend at least 2-4 feet (and perhaps more) below the lower end of extendable anchoring pole 10 (to extend its reach), with the drawing sheet size limitation preventing a to-scale illustration of independent rod 12 positioning. FIG. 10 is one example of a helicoil 15 that could be used in the small threaded bores 5 and 6 of the most preferred embodiment of block mounting devices 1, 1' to reduce wear and prevent slippage after repeated tightening and release of fasteners 11 within threaded bores 5 and 6. Thus, helicoil 15 use is preferred in small threaded bores 5 and 6 in block mounting devices 1,1', as well as in the threaded fastener bore 14 of preferred embodiments of small stabilizer blocks 13, 13'.

The present invention block mounting devices 1, 1' and small stabilizer blocks 13 13' add stability to the extendable anchoring pole 10 of shallow water anchoring system 7 during travel of boat 8 on a boat trailer (not shown) by strengthening the neck of extendable anchoring pole 10 and decreasing vibration. Similar stabilization of extendable anchoring pole 10 and independent rod 12 is experienced with the use of block mounting device 1 and small stabilization block 13 in underwater applications of extendable anchoring pole 10 and independent rod 12. Although not limited thereto, high-density polyethylene (HDPE) is the most preferred material of use in present invention mounting block device 1. Also, the smaller threaded bores 5 and 6 of the most preferred embodiments of the present invention would each have a stainless steel helicoil 15 secured therein to reduce wear and prevent slippage after repeated tightening and release of fasteners 11. In addition, although not limited thereto, the most preferred embodiment of the present invention block mounting device 1 has a length dimension of approximately seven-and-one-half inches, a width dimension of approximately three-and-one-sixteenths inches, and a thickness dimension of approximately two inches. Also, preferably in the most preferred embodiment of the present invention block mounting device 1, but not limited thereto, large longitudinal bore 3 has a smooth non-threaded interior and a diameter dimension a little greater than 1-inch, small longitudinal bore 4 has a smooth non-threaded interior and a diameter dimension of approximately three-fourths inches, and small threaded bores 5 and 6 each have a diameter dimension of approximately one-fourth-of-an-inch. Furthermore, the centers of the longitudinal bores 3 and 4 in the most preferred embodiment of the present invention are both located approximately seven-eighths-of-an-inch from the side of the block mounting device 1, through which the fasteners 11 are secured, the radius of each chamfered corners is approximately one-fourth-of-an-inch, and fasteners 11 have a preferred thread count of approximately 20-per-inch. In addition, when three threaded bores 6 are used in association with large longitudinal bore 3, adjacent bores 6 are positioned approximately two-and-three-fourths inches apart, with the outer two bores 6 each positioned approximately one inch from the adjacent-most edge of block mounting device 1. In contrast, when two threaded fastener bores 5 are used in association with small longitudinal bore 4, each bore 5 is also positioned approximately two-and-three-fourths inches from the other fastener bore 5 and also positioned approximately two-and-three-fourths inches from the adjacent-most edge of block mounting device 1. Furthermore, the rows of fastener bores 5 and 6 in the most preferred embodiment of the present invention block mounting device 1 are positioned approximately three-fourths-of-an-inch from one another. Materials and diameter dimensions of bores 3 and 4 used in the most preferred embodiments of block mounting device 1 are also used in the most preferred embodiment of small block stabilizer 13.

While the written description of the most preferred embodiments of the present invention herein is intended to enable one of ordinary skill to make and use its best modes, it should also be appreciated that such invention disclosure only provides examples thereof, and many variations, combinations, and equivalents also exist which are not specifically mentioned. Thus, the present invention block mounting device 1, 1' and small block stabilizer 13, 13' should not be considered as limited to the above-described embodiments and examples, but instead considered to encompass all embodiments within the scope and spirit of the invention, as defined by the accompanying claims.

I claim:

1. A mount used with a shallow water anchoring system secured to a boat and having an extendable anchoring pole, fasteners, and an independent rod having a length dimension longer than that of the extendable anchoring pole, said mount comprising:

a generally rectangular block mounting device having opposed ends and four sides positioned contiguous with one another;

a first longitudinal bore extending between and through said opposed ends;

a second longitudinal bore extending between and through said opposed ends at a spaced-apart distance from said first longitudinal bore and substantially parallel to said first longitudinal bore;

at least two threaded bores through one of said sides of said block mounting device, each of said at least two threaded bores having an interior end in communication with said first longitudinal bore;

at least two additional threaded bores through one of said sides of said block mounting device, each of said at least two additional threaded bores having an interior end in communication with said second longitudinal bore, wherein when the extendable anchoring pole of a shallow water anchoring system is inserted into said first longitudinal bore and fasteners are inserted into said at least two threaded bores and tightened, and when an independent rod longer than the extendable anchoring pole is inserted into said second longitudinal bore and fasteners are inserted into said additional threaded bores and tightened, and further when the lower end of the independent rod has been positioned below the extendable anchoring pole of the shallow water anchoring system, the independent rod becomes an extension for the anchoring pole in depths of water that exceeds the intended reach of the shallow water anchoring system;

further comprising a stabilizer mount having two open ended stabilizer bores positioned at a spaced-apart distance from one another, with a first of said stabilizer bores having a diameter dimension similar to said first bore of said block mounting device and containing said extendable anchoring pole, and a second of said stabilizer bores having a diameter dimension similar to said second bore of said block mounting device and containing said independent rod, with said stabilizer bores also spaced apart from one another at the same distance that said first bore of said block mounting device is separated from said second bore, said stabilizer mount also having an open-ended fastener bore communicating with one of said stabilizer bores.

2. The mount of claim 1 wherein said first longitudinal bore and said second longitudinal bore are non-threaded.

3. The mount of claim 1 wherein said block mounting device has chamfered edges.

4. The mount of claim 1 wherein said threaded bores and said additional threaded bores each further have a threaded insert secured therein.

5. The mount of claim 4 wherein said threaded insert is made from stainless steel.

6. The mount of claim 1 wherein said threaded bores and said additional threaded bores extend through the same one of said sides of said block mounting device.

7. The mount of claim 6 wherein said longitudinal bores each are centered at the same distance from the one of said sides through which said threaded bores and said additional threaded bores extend.

8. The mount of claim 1 wherein said first longitudinal bore is larger in diameter than said second longitudinal bore.

9. The mount of claim 1 wherein said block mounting device is made from high-density polyethylene.

10. The mount of claim 1 wherein said block mounting device has chamfered corners.

11. The mount of claim 1 wherein said first longitudinal bore and said second longitudinal bore are non-threaded, and further wherein said block mounting device has chamfered edges and corners.

12. The mount of claim 11 wherein said at least two threaded bores and said at least two additional threaded bores each have a threaded insert, said threaded bores and said additional threaded bores extend through the same one of said sides of said block mounting device, said threaded bores are in perpendicular orientation to said first longitudinal bore, said additional threaded bores are in perpendicular orientation to said second longitudinal bore, and said longitudinal bores are each centered at the same distance from the one of said sides through which said threaded bores and said additional threaded bores extend.

13. The mount of claim 11 wherein said threaded bores and said additional threaded bores extend through the same one of said sides of said block mounting device.

14. The mount of claim 13 wherein said longitudinal bores each are centered at the same distance from the one of said sides through which said threaded bores and said additional threaded bores extend.

15. The mount of claim 1 wherein said stabilizer mount has chamfered edges and corners.

16. The mount of claim 1 wherein said open-ended fastener bore in said stabilizer mount has a threaded insert secured therein.

17. The mount of claim 1 wherein said one of said open-ended stabilizer bores is larger in diameter than the other.

18. A method for extending the reach of a shallow water anchoring system, said method comprising the steps of:

providing a boat having an attached shallow water anchoring system with an extendable anchoring pole, a plurality of fasteners, an independent rod having a length dimension greater than that of said extendable anchoring pole, and a generally rectangular block mounting device having opposed ends and four sides positioned contiguous with one another, a first longitudinal bore extending between and through said opposed ends, a second longitudinal bore extending between and through said opposed ends at a spaced-apart distance from said first longitudinal bore and substantially parallel to said first longitudinal bore, at least two threaded bores through one of said sides of said block mounting device, each of said at least two threaded bores having an interior end in communication with said first longitudinal bore, and at least two additional threaded bores through one of said sides of said block mounting device, each of said at least two additional threaded bores having an interior end in communication with said second longitudinal bore;

further providing one additional fastener and a stabilizer block having two open-ended stabilizer bores positioned adjacent to one another, with one of said stabilizer bores having substantially the same diameter dimension and perimeter configuration as said first longitudinal bore of said block mounting device, and the other one of said stabilizer bores having substantially the same diameter dimension as said second longitudinal bore of said block mounting device, with said stabilizer bores also spaced apart from one another at substantially the same distance separating said first longitudinal bore of said block mounting device said second longitudinal bore, with said stabilizer mount also having an open-ended fastener bore communicating with one of said stabilizer bores;

inserting said extendable anchoring pole through said first longitudinal bore of said block mounting device;

tightening one of said fasteners in each of said threaded bores communicating with said first longitudinal bore to secure said extendable anchoring pole of said shallow water anchoring system in a fixed position within said first longitudinal bore;

inserting said independent rod through said second longitudinal bore of said block mounting device;

tightening one of said fasteners in each of said threaded bores communicating with said second longitudinal bore to secure said independent rod in a fixed position within said second longitudinal bore;

inserting said extendable anchoring pole through the one of said stabilizer bores having substantially the same diameter dimension and perimeter configuration as said first longitudinal bore of said block mounting device;

tightening said one additional fastener to secure said stabilizer block to said extendable anchoring pole of said shallow water anchoring system; and inserting said independent rod through the one of said stabilizer bores having substantially the same diameter dimension and perimeter configuration as said second longitudinal bore of said block mounting device, and when said independent rod is needed for anchoring use, loosening said fasteners in said second longitudinal bore, moving said independent rod downward until its bottom end becomes inserted into a sea bottom, wherein said independent rod extends the reach of said extendable anchoring pole in water having a greater depth than the intended reach of said shallow water anchoring system.

* * * * *